US005275664A

United States Patent [19]

Brown et al.

[11] Patent Number: 5,275,664

[45] Date of Patent: Jan. 4, 1994

[54] APPARATUS FOR APPLICATION OF A MATERIAL TO AN EXTERNAL SURFACE OF ITEMS OF MANUFACTURE

[75] Inventors: Robert L. Brown, Hartville; David E. Baxter, Ravenna; Todd A. England, North Canton, all of Ohio

[73] Assignee: GenCorp Inc., Fairlawn, Ohio

[21] Appl. No.: 691,953

[22] Filed: Apr. 26, 1991

[51] Int. Cl.[5] ..... B05C 1/02

[52] U.S. Cl. ..... 118/695; 118/696; 118/707; 118/64; 118/225; 118/233; 118/239; 118/255; 118/500; 118/DIG. 11; 198/487.1; 198/803.12

[58] Field of Search ..... 118/696, 697, 64, 66, 118/225, 233, 239, 255, 500, DIG.; 198/487.1, 803.12

[56] References Cited

U.S. PATENT DOCUMENTS

| | | | |
|---|---|---|---|
| 1,974,098 | 9/1934 | Becker et al. | 118/66 |
| 2,365,775 | 3/1944 | Punte . | |
| 2,411,042 | 11/1946 | King et al. | 118/66 |
| 2,838,023 | 6/1958 | Jaime | 118/66 |
| 3,080,846 | 3/1963 | Swartz | 118/66 |
| 3,310,029 | 12/1962 | Ivanoff et al. . | |
| 3,560,166 | 2/1971 | Walles | 118/66 |
| 3,635,193 | 1/1972 | Stease | 118/66 |
| 3,696,777 | 10/1972 | Preen | 118/233 |
| 3,766,851 | 10/1973 | Sirvet et al. . | |
| 3,864,603 | 2/1975 | Kozinski et al. | 118/707 |
| 3,865,076 | 2/1975 | Wick et al. | 118/66 |
| 3,895,126 | 7/1975 | Strauss et al. | 118/66 |
| 3,902,453 | 9/1975 | Frische | 118/66 |
| 3,955,496 | 5/1976 | Urban . | |
| 4,055,971 | 11/1977 | Hermes | 118/67 |
| 4,056,185 | 11/1977 | Cartwright . | |
| 4,066,038 | 1/1978 | Shutie et al. . | |
| 4,089,294 | 5/1978 | Lasiewicz et al. | 118/232 |
| 4,138,941 | 2/1979 | McMillin et al. | 198/487.1 |
| 4,296,708 | 10/1981 | Robertson et al. . | |
| 4,313,982 | 2/1982 | Miura | 118/233 |
| 4,370,943 | 2/1983 | Watanabe et al. | 118/233 |
| 4,433,776 | 2/1984 | Edwards, Jr. et al. . | |
| 4,442,788 | 4/1984 | Weis | 118/67 |
| 4,453,626 | 6/1984 | Roberts et al. . | |
| 4,608,646 | 8/1986 | Goodrich et al. . | |
| 4,753,336 | 6/1988 | Taylor et al. . | |
| 4,836,139 | 6/1989 | Davies | 118/696 |
| 4,886,157 | 12/1989 | Sunnen et al. . | |

FOREIGN PATENT DOCUMENTS

| | | | |
|---|---|---|---|
| 954108 | 9/1982 | U.S.S.R. | 118/696 |

*Primary Examiner*—W. Gary Jones
*Assistant Examiner*—Todd J. Burns

[57] ABSTRACT

An apparatus for application of material to the external diameters of cylindrical items of manufacture. The apparatus includes a frame, a transport system having work stations supporting the items, an application system, and a curing system for curing the material applied to the cylindrical items. The application system includes first and second horizontally, axially spaced application rolls engagable with the items external diameter, and an adjustable reservoir system for supplying a desired thickness of material to be applied to the external diameter of the item.

6 Claims, 9 Drawing Sheets

| 1A | 1B | 1C |
|---|---|---|

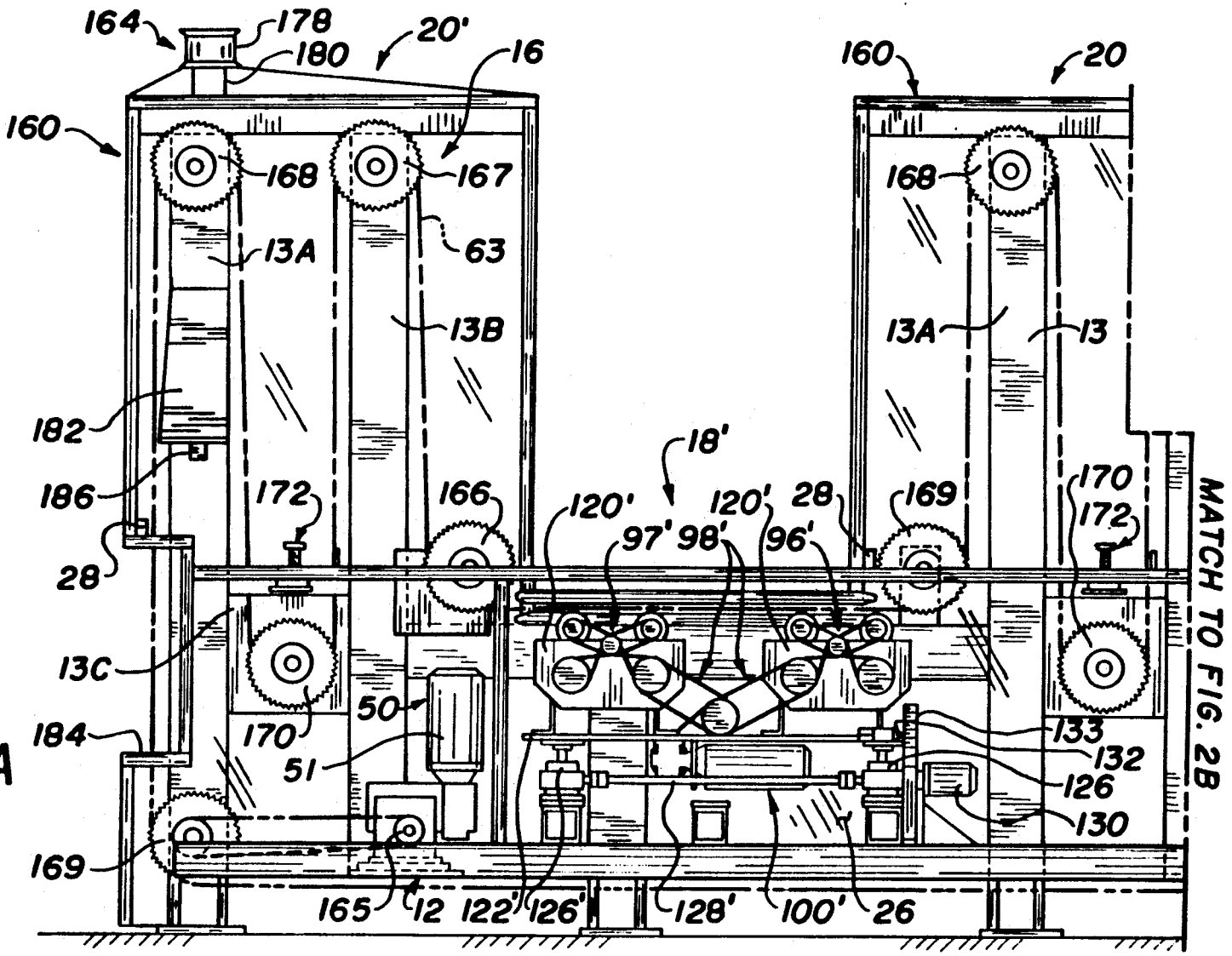
FIG. 2A
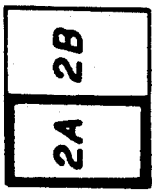

APPARATUS FOR APPLICATION OF A MATERIAL TO AN EXTERNAL SURFACE OF ITEMS OF MANUFACTURE

TECHNICAL FIELD

The present invention relates to an apparatus for applying material, and more particularly to an apparatus for the application of a liquid material to the external diameters of cylindrical items of manufacture.

BACKGROUND OF THE INVENTION

Devices for applying liquid materials to cylindrical items of manufacture are well known in the manufacturing industry. The external diameters of cylindrical items are, for example, coated with paint or other material in the packaging industry, and with adhesive material in the automotive parts industry. One common method of applying adhesive material to parts manufactured for the automotive industry is spray coating.

One disadvantage of the spray coating process in connection with the application of adhesive is that it is quite inefficient. It is estimated that only 15%-20% of sprayed coating material adheres to the part surface being coated. Thus, as much as 80%-85% of the often expensive coating material being sprayed may be "lost".

An additional disadvantage, is that the adhesives typically used for automotive parts in spray processes are often volatile organic based materials. The atomization of such materials may result in vapors which should not be released directly into the environment. Thus, the "lost" material must be reclaimed. Reclamation of such material typically involves the use of a water retrieval system. Treatment of the waste water resulting from the operation of retrieval systems is also expensive.

U.S. Pat. No. 4,296,708, for example, provides an apparatus for roll coating the external diameters of cylindrical parts with adhesive material using fiber felt rolls. Such devices require the cylindrical part to be moved between drive and idler rolls and are not capable of applying in a precise and repeatable manner specific coating thicknesses.

SUMMARY OF THE INVENTION

The present invention provides a new and improved apparatus for application of a liquid material to the external diameters of cylindrical items of manufacture. The apparatus is preferably designed to apply material to an increased number of cylindrical items, and to apply the material in precise and desired amounts. The precision application provided by the present invention also increases the repeatability of material application to the external diameter of the items.

An apparatus according to the present invention includes a part supply system, a frame supporting a transport system, an application system, a curing system for curing the material applied to the cylindrical items, a take-away system for removing the completed cylindrical items and a controller for controlling position and movement of the cylindrical items through the apparatus at desired locations and specified speeds.

The transport, coating and drying systems are enclosed by clear walls and covers to enable viewing of the apparatus during operation, while maintaining the safety of the operator against moving parts and fumes which may result from application of the material. To ensure that the operator or others cannot gain access to the apparatus during operation, a series of door interlock switches are preferably positioned such that opening of the covers to gain access to the apparatus halts operation.

The part supply system may include manual or automatic feed systems. Using a manual system, the cylindrical items are provided by an operator. Using an automatic system, such as rotary or vibratory feed systems, the items are provided automatically in the desired number and orientation. Additionally the part supply system includes a loading system for providing the cylindrical items to the transport system.

The cylindrical items of manufacture to which material is applied to the external diameter have at least one open end. The transport system for moving the items is a continuous pin-type conveyor system with multiple pin assembly work stations. The pin assemblies support the items on their internal surface, and move them on the conveyor. Depending on the length of the cylindrical items, one or more items may be loaded onto the pin assembly work stations, thereby increasing the number of parts moved through the apparatus.

The cylindrical items are loaded onto the pin assemblies by the loading system, which also includes a continuous conveyor system with multiple v-shaped blocks for supporting the items. A single drive mechanism operates the conveyors of the part supply loading system and the transport system. The use of such a single interconnected drive mechanism ensures synchronized movement of the cylindrical items within the apparatus.

In the loading system, the cylindrical items are biased from their positions on the blocks onto the pin assemblies by an inclined plate or ski positioned along the length of the loading system, and located at a selected height, depending on the diameter of the cylindrical items. The loading system is adjustable to load items of different diameters to the transport system. In the event a cylindrical item is not fed properly onto its pin assembly, the loading system is also provided with a spring biased safety interlock. The safety interlock stops the entire apparatus to prevent damage to the pin assemblies and any other moving portions of the apparatus.

After being loaded onto the transport system conveyor, the items are moved on their respective pin assemblies to the application system. The application system includes two coating stations. Each of the coating stations includes a driving system and a reservoir system. A single drive mechanism is used to operate both of the coating station driving systems. Each of the driving systems includes two horizontally and axially spaced coating rolls which sequentially engage the external diameter of the cylindrical items as they move along the transport system.

The timed engagement between the cylindrical items and the coating rolls at the coating stations effects the precise application of the coating material to the items. Thus, to obtain the desired application of material, the speeds of the transport system and the coating rolls of the driving system may be varied as necessary, using either a manual control or by the controller. In addition to speed variation, the direction of the coating rolls may also be varied to obtain the desired coating of the cylindrical items. Also, coating rolls having different surface characteristics, such as smooth metal, grooved metal, polymer or fabric materials, may be used to ensure that the liquid material is successfully applied to the cylindrical items. It is noted that the same liquid material may be applied by the two coating rolls at the two coating stations. Alternatively, each station may apply a different material.

During operation of the application system, the spaced coating rolls are in contact with a reservoir of the reservoir system containing the desired coating material. The contact between the coating rolls and material reservoir during operation provides continuous agitation of the liquid material within the reservoir. The reservoirs containing the material are readily removable to enable maintenance of the apparatus, or to change the liquid material in the reservoir. Use of the application system of the present invention reduces the percentage of coating material wasted during the coating process to 15% or less.

To ensure that the external diameters are provided with the desired thickness of coating material, the reservoir system includes an adjustment mechanism. The adjustment mechanism enables control of the position of the reservoir, and selection of the desired thickness of coating material to be applied. The adjustment mechanism may be manually controlled by an operator, or alternatively, the desired settings can be automatically adjusted using the controller.

Upon exiting the application system, the conveyor moves the coated cylindrical item into communication with the curing system. The curing system includes either or both a heating oven and a drying chamber. A heating oven may be necessary to cure the material by increased temperature, for example. A drying chamber may be used to air dry the coating material. The drying chamber of the present invention includes a ventilation system which provides ambient air to the chamber, and an exhaust system which is used to discharge air and fumes from the chamber. The ventilation system directs drying air across the surfaces of the cylindrical items exiting the application system. The fan of the exhaust system pulls the drying air through the chamber. During operation of the exhaust fan, a negative pressure area is created adjacent the application system to remove interfering fumes from the application system. The items are quickly dried by properly maintaining and controlling air flow over the cylindrical items and through the drying chamber. Additionally, necessary environmental requirements are also satisfied by controlling the air exiting the drying chamber using the exhaust system.

As the cylindrical items are cured and approach the curing system exit, they are removed from their pin assembly positions on the transport system conveyor by an inclined plate or ski similar to that used in the loading system. The ski is positioned at the exit of the curing system, and is also provided with a spring biased safety interlock, in the event a cylindrical item is not properly removed from the transport system or loaded to the take-away system. The safety interlock stops movement of the conveyors of the various systems to prevent damage to the conveyors and the apparatus.

From exiting the curing system, the completed cylindrical items are then transferred to the take-away system for removal to a still further or final processing station. The take-away system may be a gravity feed chute to a separate container, or a separate conveyor system for automatic removal of the items to their next or final process station.

Other features and advantages of the present invention will become apparent from the following detailed description of preferred embodiments made with reference to the accompanying drawings, which form a part of the specification.

BRIEF DESCRIPTION OF THE DRAWINGS

FIGS. 2A and 2B are schematic partial front views of portions of the apparatus illustrated in FIGS. 1A–1C;

DETAILED DESCRIPTION OF THE PREFERRED EMBODIMENT

Figure 1A:
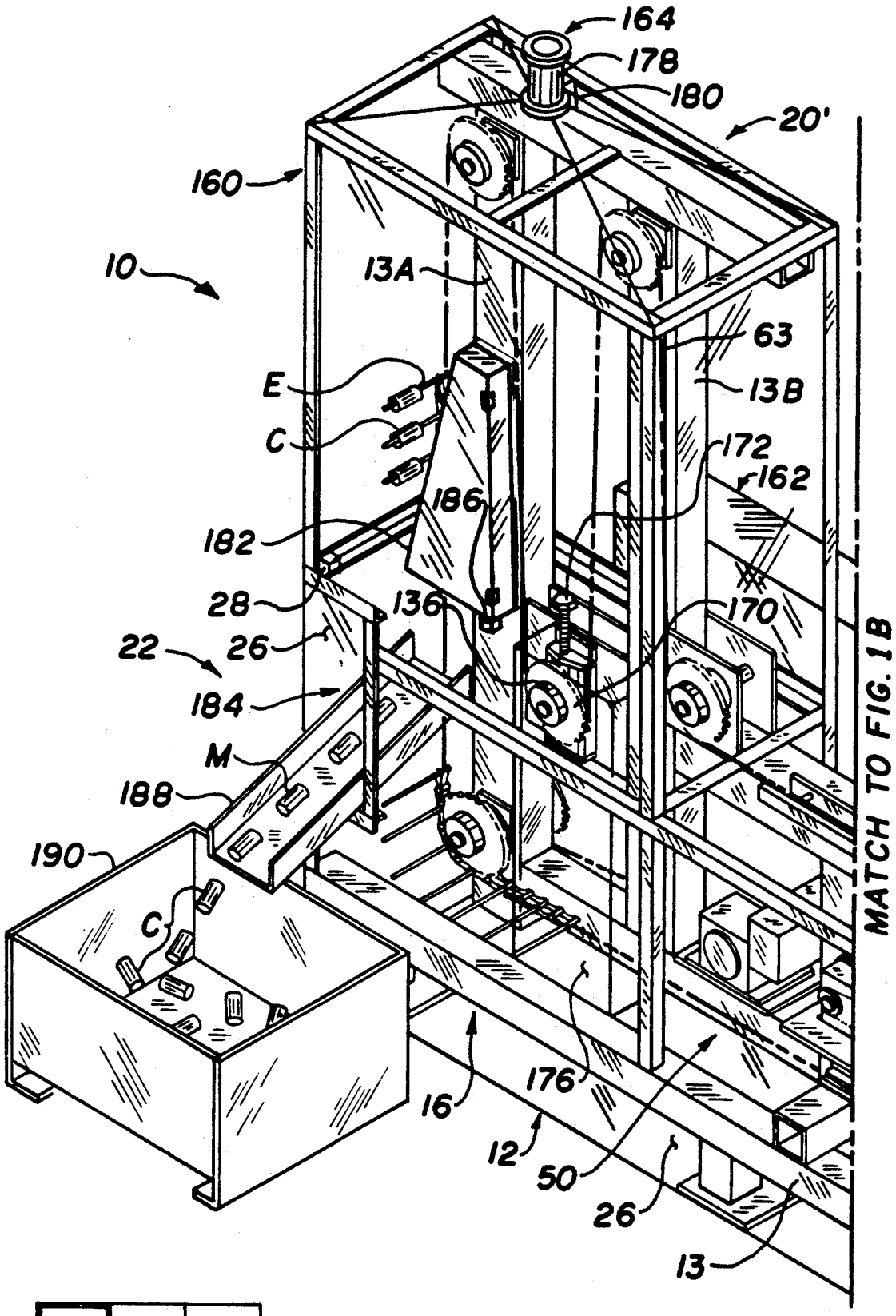
FIGS. 1A, 1B, and 1C illustrate schematic partial perspective views of an apparatus for applying material to the external diameters of cylindrical items of manufacture in accordance with the present invention.
Figure 1B:
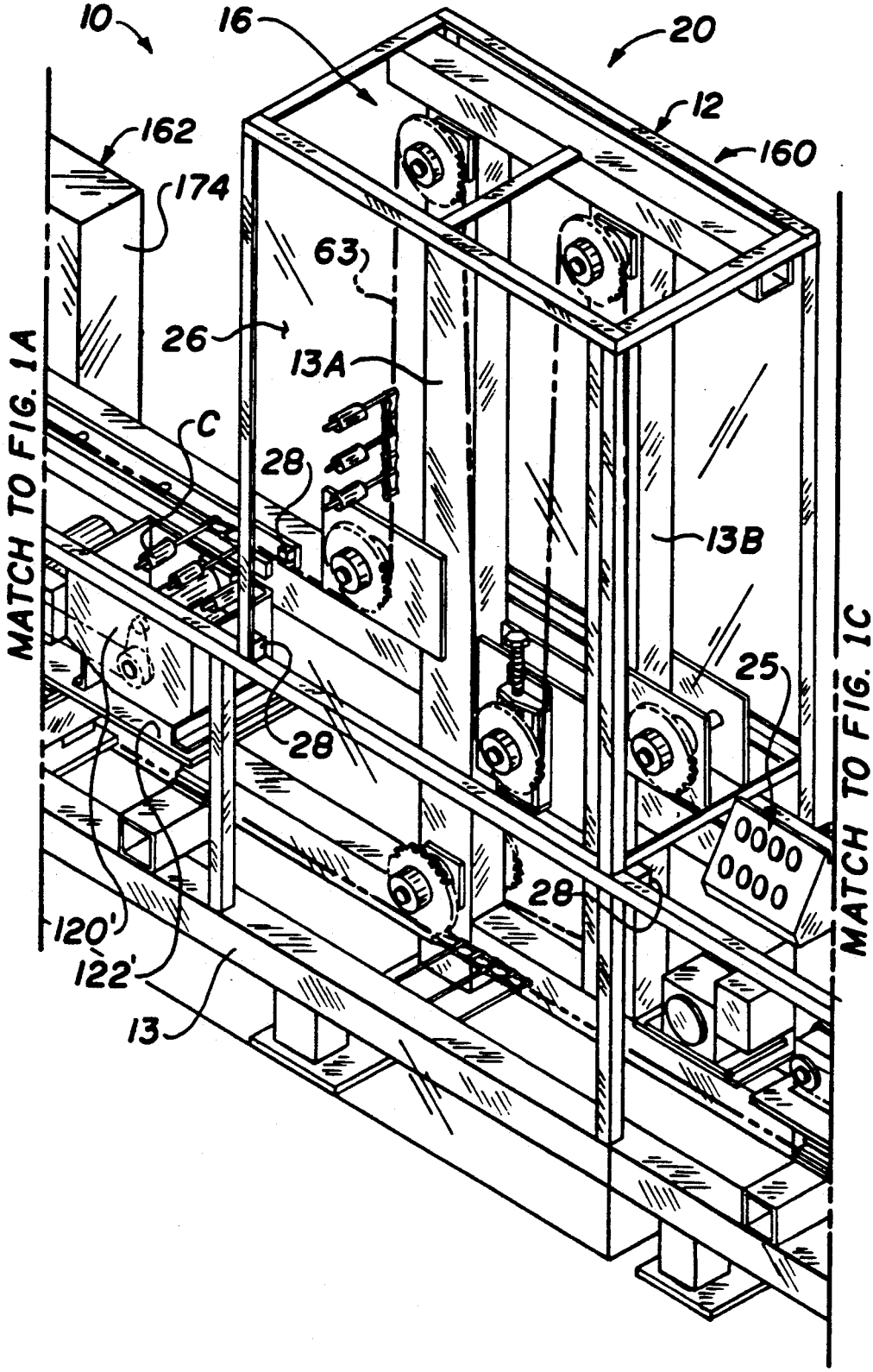
Figure 1B:
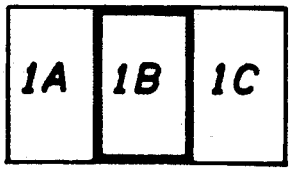
Figure 1C:
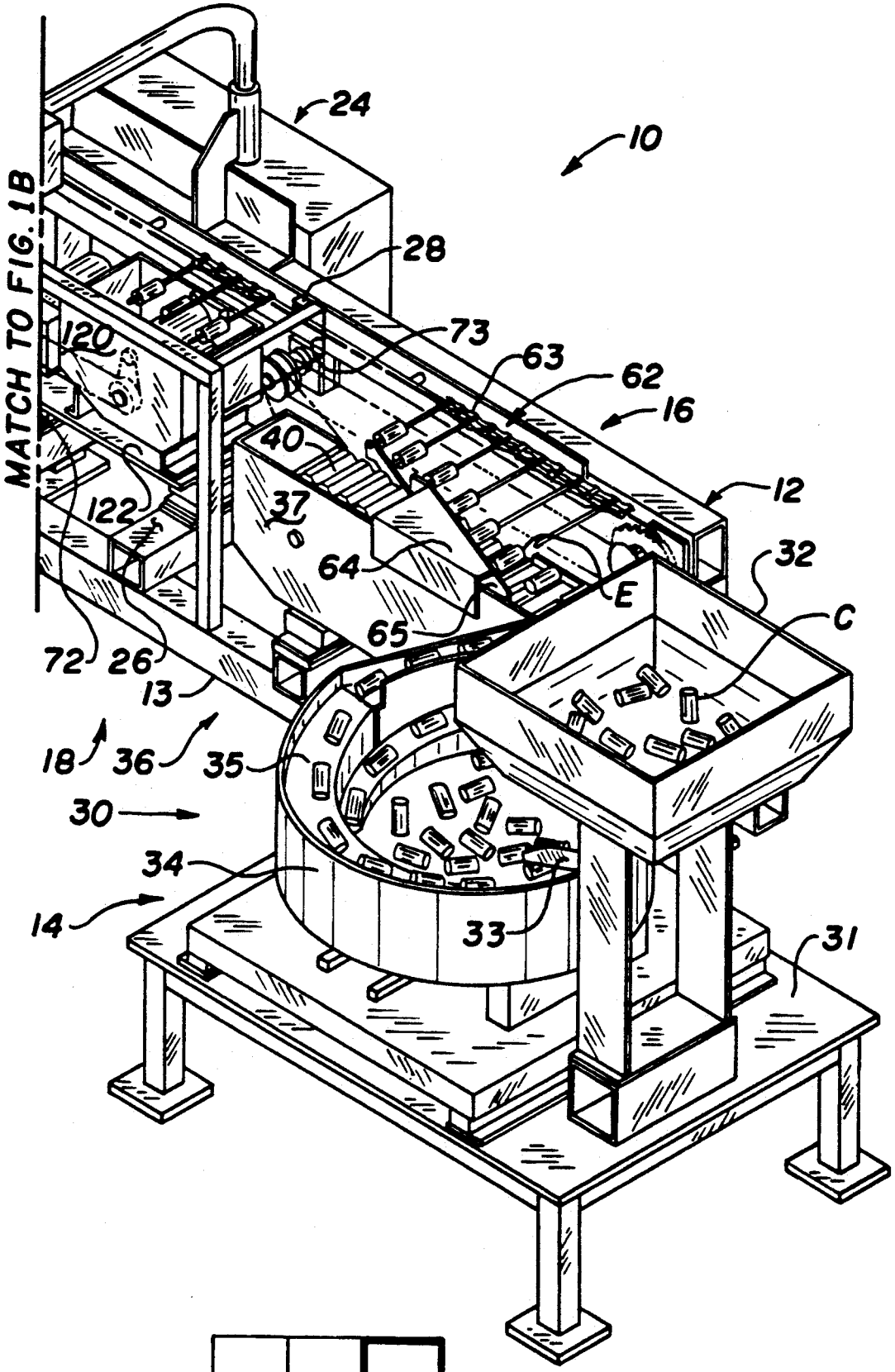
Figure 1C:
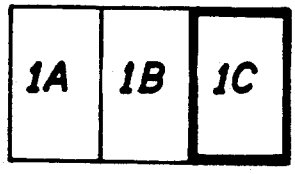

FIGS. 1A, 1B and 1C illustrate an apparatus 10 for applying material M to the external diameters of cylindrical items C having at least one open end E. The apparatus, generally referred to at reference numeral 10, includes a frame 12 supporting a part supply system 14 and a transport system 16. Also provided are an application system 18, a curing system 20 for curing the material M applied to the cylindrical items C, a take-away system 22 for removing the completed cylindrical items, and a controller 24 for controlling position and movement of the cylindrical items through the apparatus 10 at desired locations and specified speeds. The frame 12 comprises metal support members 13 for supporting and defining the transport, application and curing systems 16, 18, 20, respectively.

It should be understood that the embodiment of the apparatus 10 illustrated includes two application systems 18, 18' and two curing systems 20, 20'. In the first application system 18 a primer material is applied to the items. The items then proceed to a first curing system 20, and exit to a second application system 18', where a secondary and any finish material is applied to the items. The items then proceed to a second curing system 20', before exiting to the take-away system 22. Single application and curing systems may be used, or multiple combinations of application and curing systems may be used to complete manufacture of the desired cylindrical items. As the first and second application systems 18, 18' and the first and second curing systems 20, 20' are substantially similar, each of the second systems 18', 20' will be referred with a prime designation, and only the differences between the first and second systems will be discussed in further detail.

The transport, application and curing systems 16, 18, 20 are supported on the frame 12 enclosed within clear walls and hinged covers 26, which are also supported on the frame 12. The use of clear walls and covers permits the operator to view the apparatus 10 during operation, while preventing exposure to the apparatus' moving parts, or fumes from material application. The walls and covers 26 are manufactured of a clear synthetic resin material, for example Tempered Glass.

Cover or door interlock switches 28 are positioned adjacent each hinged cover 26, and are electrically interconnected to the controller 24. In the event the covers 26 are manually opened during operation of the apparatus 10, the interlock switches 28 operate to halt operation. Such safety interlocks ensure that the operator cannot access the apparatus during operation.

A preferred part supply system 14 of the present invention is illustrated in FIG. 1C, in the form of a conventional vibratory feed system 30. As shown in FIG. 1C, the feed system is supported on a platform 31 adjacent the frame 12 of the apparatus 10. Cylindrical items C are supplied to a loading container 32 of the feed system 30, and moved by gravity via a chute 33 to a central container 34. By vibration of an inclined feeder 35, cylindrical items C are axially aligned for movement onto a loading system 36 of the part supply system 14.

Figure 2B:
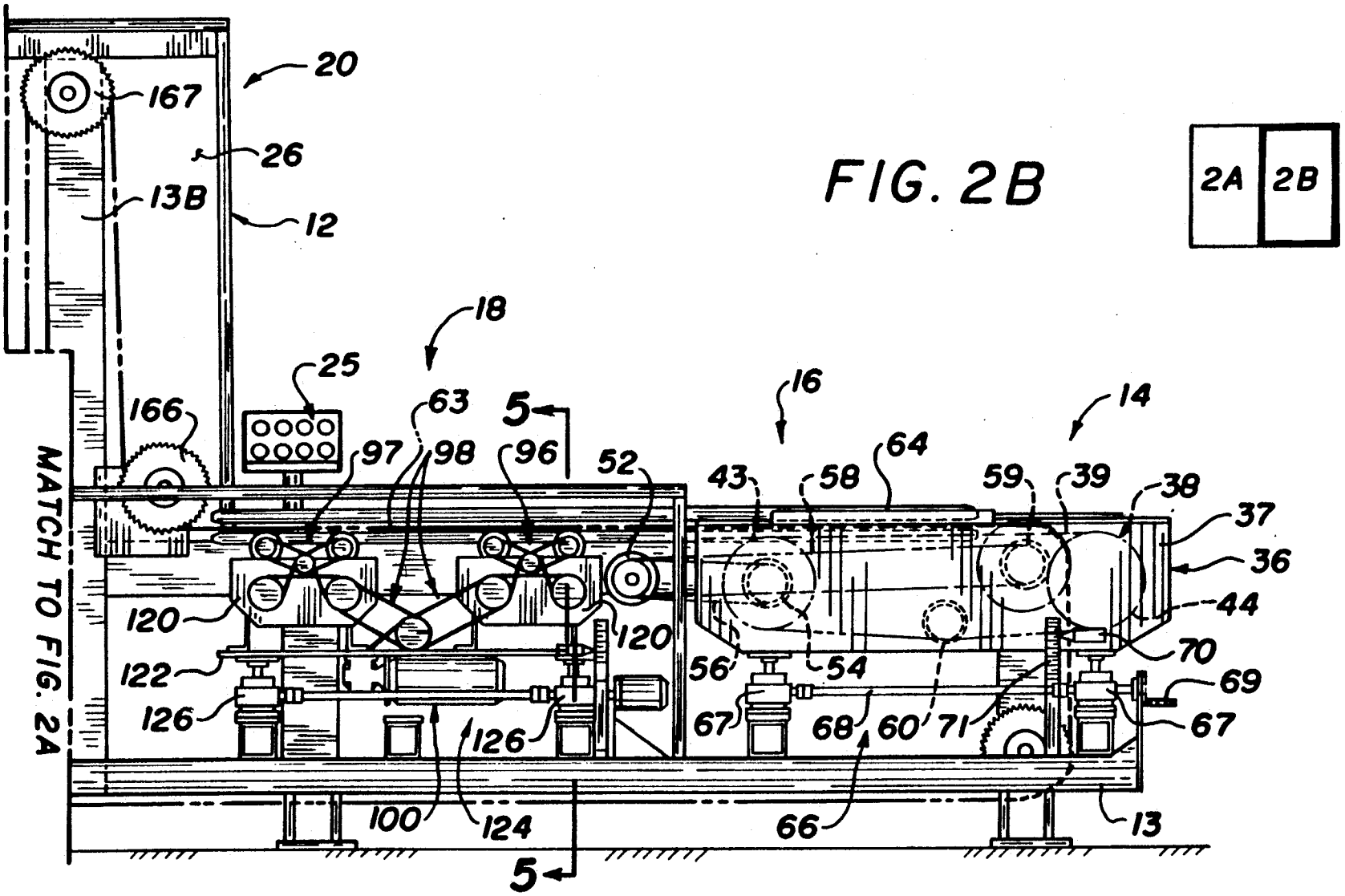
Figure 3A:
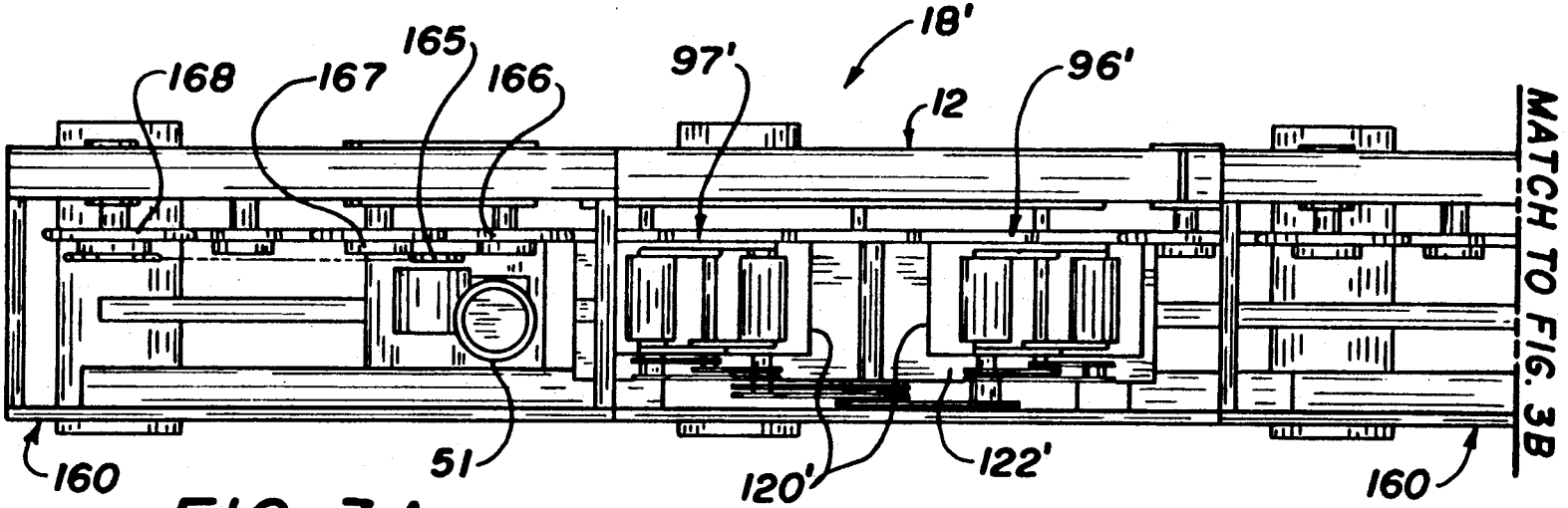
FIGS. 3A and 3B are schematic partial top views of the apparatus illustrated in FIGS. 2A and 2B, respectively.
Figure 3B:
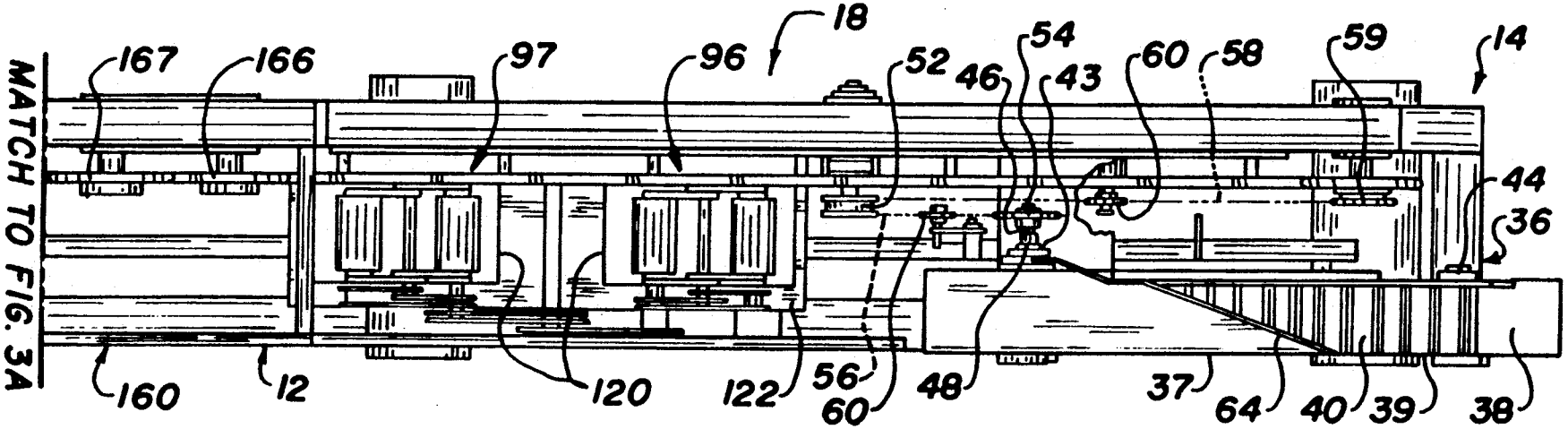

The loading system 36 of the present invention is illustrated in FIGS. 2B and 3B, and provides the cylindrical items C to the transport system 16. As shown in FIG. 2B, the loading system 36 includes a main body 37 which is supported on the apparatus frame 12. The main body 37 supports a conventional continuous v-block conveyor system 38 which transports the cylindrical items to the transport system 16. The conveyor system 38 includes a continuous chain 39 having v-shaped blocks 40 for supporting the items C. The v-blocks 40 are secured to the chain 39 which engages first and second sprockets 43, 44 which are rotated by a drive shaft 46 supported on flange bearings 48. The shaft and sprockets are driven by a main drive mechanism 50 which operates the conveyors of both the loading system 36 and the transport system 16.

In the embodiment illustrated, the main drive mechanism 50 includes a conventional gear motor 51. The drive shaft 46 and sprockets 43, 44 are interconnected with the main drive mechanism 50 by a series of chain drives as shown schematically in FIGS. 2A and 2B. Operation of a single main drive mechanism enables synchronized movement to be maintained as the cylindrical items move through the apparatus 10.

As illustrated schematically in FIG. 2B, the drive sprocket 43 is interconnected with a transfer sprocket 52, via a conventional torque limiting drive sprocket 54 and a transfer chain 56. The transfer sprocket 52 is interconnected via a drive chain 58 to a drive sprocket 59 of the transport system 16. Conventional adjustable take-up sprocket assemblies 60 are positioned along the chains 39, 56 and 58 to maintain the proper chain tension in the conveyor systems 36, 16.

As schematically illustrated in FIGS. 1A-1C and 2A-2B, the transport system 16 for moving the items C through the apparatus 10 is a continuous chain, pin-type conveyor system having multiple pin assembly work stations 62, as described herein. Multiple drive and take-up sprockets 59 are supported along the frame 12 of the apparatus 10. The sprockets are driven via an interconnected main chain 63, by a gear motor 51, as shown in FIG. 2A.

From their axially aligned positions on the feeder 35 of the feed system 30, the cylindrical items C are moved into the v-shape formed by the v-shaped blocks 40 on the loading system conveyor 36. As the v-shaped blocks are moved in a direction toward the application system 18, the open end E of each cylindrical item supported in a v-shaped block 40 is biased by an inclined ski member 64 onto a pin assembly work station 62, which supports the items on an internal surface. The fixed position inclined ski member or plate 64 is positioned along the loading system 36 spaced above the v-shaped blocks 40. The v-shaped blocks are positioned at a selected height relative to the pins, which height depends on the diameter of the cylindrical items C.

In the event a cylindrical item is not properly fed onto its respective pin assembly 62 by the ski member 64, the loading system 36 also includes a spring biased safety interlock 65. The safety interlock 65 is spring biased into position for normal operating conditions. In the event the pressure acting upon the ski member 64 exceeds normal operating conditions, the spring of the safety interlock is biased out of position and movement of the entire system stops.

As illustrated in FIG. 2B, the loading system 36 is supported on the frame 12 by an adjustment mechanism 66. The adjustment mechanism enables vertical position adjustment of the loading system 36 depending on the size of the items to be provided relative to the pin assembly work stations 62 of the transport system 16. In the preferred embodiment, the adjustment mechanism 66 may vary the vertical position of the loading system 36. The adjustment mechanism 66 in the illustrated embodiment includes conventional jacks 67 supporting the main body 37 of the loading system 36 on support members 13 of the frame 12. Each of the jacks 67 may be vertically raised or lowered by approximately 3 inches by a connecting shaft 68 which is manually actuated by a hand wheel 69. Alternatively, the hand wheel 69 may be substituted for a stepper motor interconnected with the controller 24 for automatically adjusting the vertical position of the loading system 36. The desired relative vertical adjustment of the loading system 36 is measured using a pointer 70 and scale 71. The scale 71 is secured to the support member 13 and the pointer 70 is secured to the main body 37.

Once the cylindrical items C are engaged on the pin assembly work stations 62 of the transport system 16, they are moved into the application system 18 for application of the coating material M. An air curtain device 72 is provided in the embodiment of the invention illustrated in FIG. 1C. The air curtain device 72 surrounds an opening 73 in the clear wall 26 adjacent the application system 18. The air curtain device 72 is interconnected with the curing system 20, and provides a curtain of air across the opening 73 to reduce fume migration from the material past the walls and covers 26 enclosing the application and curing systems 18, 20.

Figure 5:
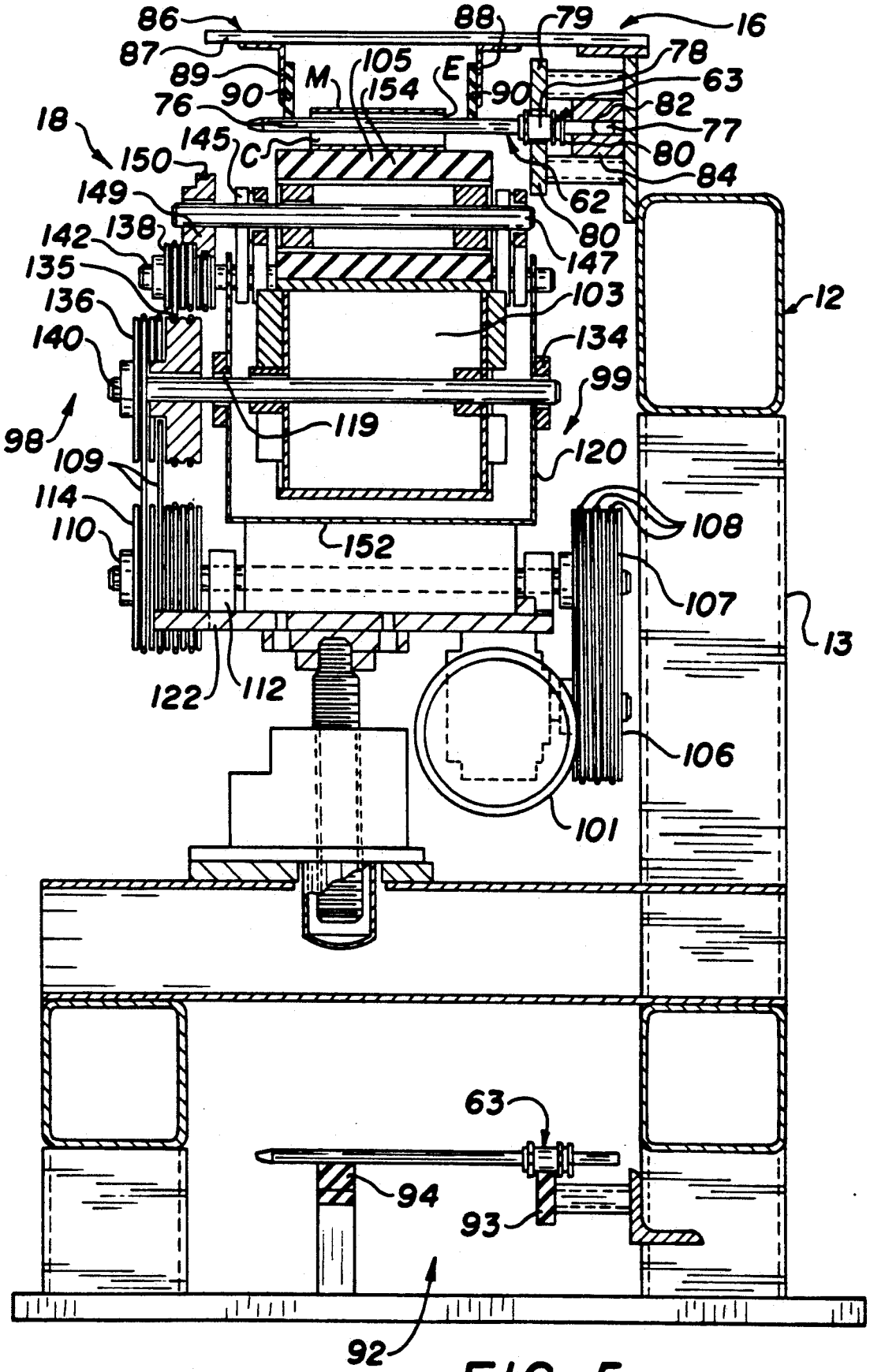
FIG. 5 is a schematic partial, cross-sectional view of the application system taken along the line 5—5 of FIG. 2B.

The cylindrical items are moved through the air curtain device 72 into the application system 18 on the pin assembly work stations 62 of the transport system 16, as illustrated in FIG. 5. The illustrated pin assembly work stations 62 of the present invention include a pin 76. One end 77 of the pin 76 is engaged through an opening in a hollow link 78 of the main chain 63. Once the one end 77 of the pin is engaged through the hollow link 78, a retaining ring 80 is engaged within a groove (not illustrated) formed in the one end of the pin 76. The groove and retaining ring 80 resist removal of the pin from the main chain 63 during operation of the apparatus 10. In the event it is necessary to replace a pin 76 due to wear or other damage, the pin may be readily removed from the link 78 and replaced, once the retaining ring is removed.

The pin assembly work stations 62 and main chain 63 are moved through the loading system 36 and transport system 16 supported between upper and lower chain guides 79, 80, as shown in FIG. 5. The one end 77 of the pin 76 is also supported within an opening 82 in a pin stabilizer bar 84. Additionally, an upper ski assembly 86, supported adjacent the upper chain guide 79, engages the pin 76 during movement through the application system 18 to insure alignment of the cylindrical item with the coating rolls.

The upper ski assembly 86 prevents movement of the cylindrical item C out of engagement with the pin 76 during the application of material. The ski assembly 86 is supported on a mounting bracket 87, which has an inner ski 88 and an outer ski 89 attached thereto. Attached to each of the skis 88, 89 is a wear strip 90 of a polymer composite material for engagement with the pin 76 as shown in FIG. 5. A lower ski assembly 92 is also provided for supporting the pins 76 on their return to the loading system 36 for additional items. The lower ski assembly 92 includes a lower chain guide 93 for supporting the main chain 63, and a lower ski wear strip 94 for supporting the pin 76.

Figure 4A:
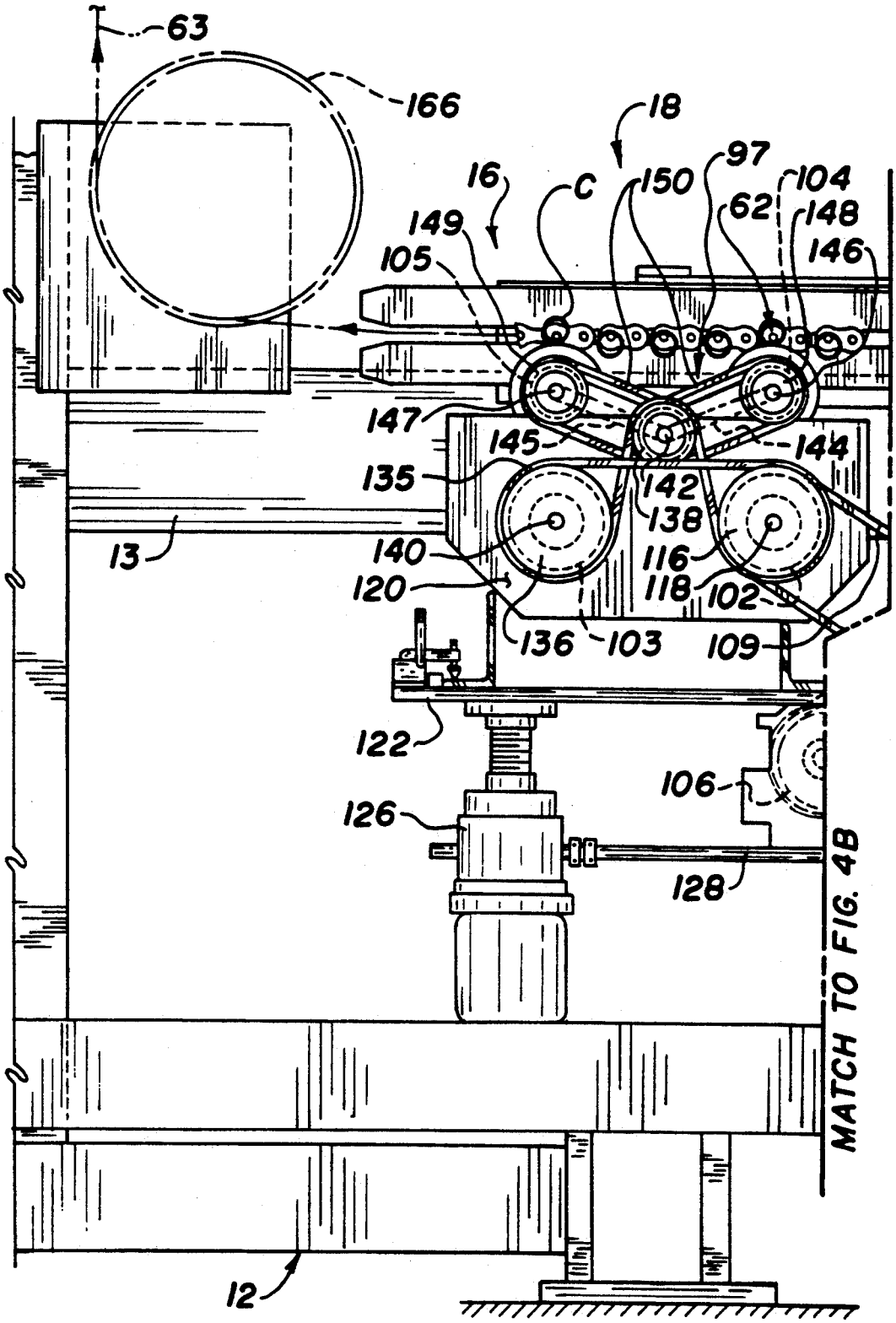
FIGS. 4A and 4B are schematic partial front views of the application system and adjustment mechanism of the apparatus illustrated in FIG. 2B.
Figure 4A:
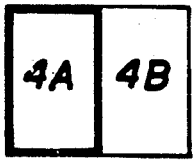
Figure 4B:
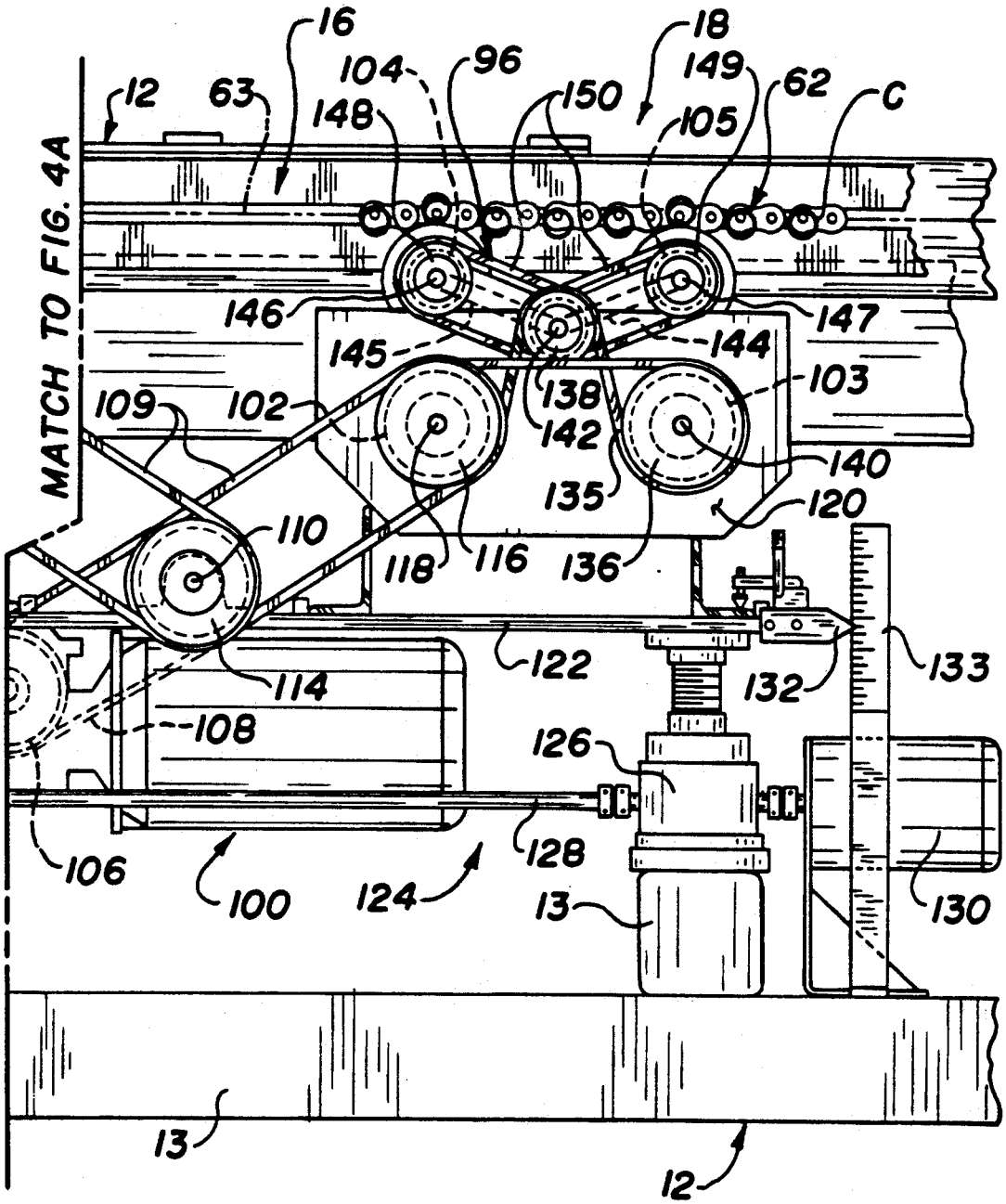
Figure 4B:
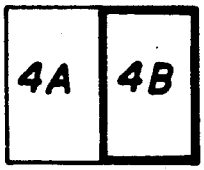

The application system 18 of the apparatus of the present invention is illustrated in FIGS. 2A-2B and 3A-3B, and more particularly in FIGS. 4A-4B and 5. The application system 18 of the preferred embodiment of FIGS. 2A-2B includes first and second coating stations 96, 97, each having a driving system 98 and a reservoir system 99. In the alternate preferred embodiment of FIGS. 1A-1C, two application systems 18, 18[1] are shown, with each system including a single coating station 96, driving system 98 and reservoir system 99. As the single station and systems of the application systems 18, 18[1] of FIGS. 1A-1C are a substantially similar but single embodiment of the dual stations and systems shown in FIGS. 2A-5, all further discussion with respect to the application system components shall primarily refer to FIGS. 2A-5.

The reservoir system 99 includes a tank 120 supported on a mounting plate 122. The mounting plate 122 is supported by an adjustment mechanism 124 similar to that described above with respect to adjustment of the loading system 36. Adjustment of the illustrated embodiment of the application system 18 ensures that the external diameters of the items C are provided with the desired thickness of material M, by positioning the tank 120 to engage the rolls with the desired level of material. During operation of the application system 18, the two tanks 120 contain the same material M, as may be desired. Additionally, the two additional tanks 120[1] in the second application system 18[1] may also contain the same or different material M from each other and from the system 18, as may be desired. The adjustment mechanism 124 enables manual or automatic vertical position adjustment of the application system 18 by the controller depending on the size of the items to be coated and the material being applied.

In the preferred embodiment, the adjustment mechanism 124 varies the vertical position of the application system 18. Like the loading system adjustment mechanism 66, the adjustment mechanism 124 illustrated in FIGS. 4A and 4B includes conventional jacks 126 supporting the mounting plate 122 of the application system 18 on support members 13 of the frame 12. Each of the jacks 126 is vertically raised or lowered by a connecting shaft 128 which is automatically actuated by a stepper motor 130 secured to the frame 12. Alternatively, a manually actuated hand wheel may be substituted for the stepper motor. The desired relative vertical adjustment of the application system 18 is measured using a pointer 132 and scale 133. The scale 133 is secured to the support member 13 and the pointer 70 is secured to the mounting plate 122.

The driving systems 98 have a single drive mechanism 100, which operates both coating stations 96, 97. Each of the coating stations 96, 97 includes doctor rolls 102, 103 and coating rolls 104, 105, which are horizontally and axially spaced, and sequentially engage the external diameter of the cylindrical items C to apply material M as the items are moved on the pin assembly work stations 62.

In the embodiment illustrated in FIG. 5, the drive mechanism 100 includes a gear motor 101. The gear motor drives first and second drive shaft pulleys 106, 107 interconnected by belts 108, and a drive shaft 110. The drive shaft is mounted within pillow block bearings 112 secured to the mounting plate 122. A third drive shaft pulley 114 driven by the drive shaft 110 is interconnected by belts 109 to a doctor roll drive pulley 116 at each of the coating stations 96, 97. Each of the doctor roll drive pulleys 116 is supported on a doctor roll drive shaft 118.

Belts 135 interconnect each of the doctor roll drive pulleys 116 with a second doctor roll pulley 136, and a coating roll drive pulley 138. The second doctor roll pulleys 136 are supported on doctor roll shafts 140. Each of the doctor roll drive shafts 118 and shafts 140 extend through openings 119 in the tanks 120. The doctor roll drive shafts 118 and shafts 140 are supported for rotation in bearing blocks 134 positioned on the outside surfaces of the tanks 120.

The first doctor roll 102 is secured on the doctor roll drive shaft 118, and the second doctor roll 103 is secured on the doctor roll shaft 140. As illustrated in FIG. 5, the metal surfaces 152 of the doctor rolls 102, 103 engage material within the tank 120 during rotation of the doctor rolls driven by drive mechanism 100. Engagement of the doctor rolls with the material continuously moves the material during operation of the application system 18.

The coating roll drive pulley 138 is supported on a coating roll drive shaft 142, which extends through the tank 120. The coating roll drive shaft 142 additionally supports first and second pivot arms 144, 145. As shown in FIG. 4B, each of the pivot arms 144, 145 is positioned at an angle with respect to the coating roll drive shaft 142. The pivot arms 144, 145 support coating roll shafts 146, 147, which are located above the doctor roll drive shaft 118 and doctor roll shaft 140, respectively. The coating roll shafts 146, 147 each support a coating roll pulley 148, 149. The coating roll pulleys 148, 149 and roll shafts 146, 147 are driven by belts 150 interconnected with the coating roll drive pulley 138.

The first coating roll 104 is secured on the coating roll shaft 146, and the second coating roll 105 is secured on the coating roll shaft 147. As illustrated in FIG. 5, the rubber composite surfaces 154 of the coating rolls 104, 105 engage the metal surfaces 152 of the doctor rolls 102, 103, respectively, such that the material M on the doctor rolls is transferred to the coating rolls. The surfaces 154 of the coating rolls 104, 105 having the material M then engage the external surfaces of the cylindrical items C to apply the material M. It is understood that the surfaces 152, 154 of the coating and doctor rolls may be of any material or configuration, such as grooved or rough, which will hold the material to be applied to the items in the desired thickness.

Since the amount of material to be applied to the items C is primarily determined by the length of engagement between the cylindrical items C and the coating rolls 104, 105, the speed of the transport system 16 and the coating rolls 104, 105 of the driving systems 96, 97, may be varied as necessary. The speed of the main drive mechanism 50 of the transport system 16 may be varied between 10 feet per minute and 40 feet per minute. By varying the speed of the transport system, the speed of the items at the pin assembly work stations 62 may be increased or decreased as necessary. Additionally, the speed may be increased manually, using a key pad control 25, or, once established, may be automatically controlled by the controller 24 based on the size of the cylindrical item C.

The speed of the application system drive mechanism 100 may also be varied between 9 rpm and 45 rpm. By varying the speed of the application system 18, the speed at which material is applied to the items C may be increased or decreased as necessary. The application system 18 speed may be increased manually, using the key pad controls 25, or, once established, may be automatically controlled by the controller 24. The direction of operation of the driving systems 98, and thus the coating rolls 104, 105, may also be varied to obtain the desired engagement time between the rolls and the cylindrical items.

Upon exiting the application system 18 on the pin assembly work stations 62, the cylindrical items having material M applied to the external surface, are moved into the curing system 20. In the illustrated embodiment, the first or primer application system 18 applies primer materials, and the items are then moved to a first or primer curing system 20. Upon exiting the primer curing system 20 the items are moved via the transport system 16 to a second or finish application system 18'. From the finish application system 18', the items are moved to a second or finish curing system 20'. As set forth above, a single application and curing system or multiple application and curing systems may be combined, depending on the manufacturing process required. As the features and operation of the first or primer curing system 20 and second application system 18' are discussed in connection with the first application system 18 and second curing system 20', no further discussion of these systems 20, 18' is required.

The second or finish curing system 20' of the preferred embodiment of the present invention is illustrated in FIGS. 1A–1B and 2A–2B. The illustrated curing system 20' includes a drying chamber 160 which air dries the material M. The drying chamber 160 includes a ventilation system 162 which provides ambient air into the chamber 160, and an exhaust system 164 which is used to discharge air and material fumes from the chamber. As shown in FIGS. 1A and 1B, the drying chambers 160 are formed by the support members 13 of the frame 12, enclosed by Tempered Glass walls and covers 26.

The transport system 16 moves the pin assembly work stations 62 through the drying chamber 160 via the main chain 63, driven by a main drive sprocket 165 interconnected with the gear motor 51 of the main drive mechanism 50. The chain 63 is engaged over corner sprockets 166, 167, 168 and 169 mounted within the chamber 160 on vertical support members 13A, 13B of the frame 12. An adjustable center sprocket 170 is mounted on a support member 13C, located intermediate the vertical support members 13A, 13B. The center sprocket 170 includes a manual threaded slide assembly 172 for vertically moving the center axis of the sprocket 170 to take up slack within the main chain 63 as may be necessary.

The ventilation system 162 introduces ambient air into the drying chamber 160 via a fan assembly 174 located behind the drying chamber 160. Internal air ducts 176 are additionally provided within the chamber 160 for directing drying air across the coated surfaces of the cylindrical items.

The exhaust system 164 removes air and fumes from the drying chamber 160 via a fan assembly 178. The fan assembly of the exhaust system 164 is located on the top of the drying chamber 160 and pulls the exiting air in an upward direction through the chamber. During operation of the exhaust fan assembly 178, a negative pressure area is created adjacent the associated application system 18' to remove interfering fumes from the application system 18' via the exhaust system 164. By maintaining and controlling operation of the ventilation system fan assembly 174 and the exhaust system fan assembly 178, the air flow through the drying chamber and over the cylindrical items may be controlled to dry the items at the desired rate.

Control of the exhaust system 164 additionally enables control of any environmental exhaust requirements by establishing the rate of exhaust exiting the drying chamber using the fan assembly 178. To ensure that the proper exhaust requirements are maintained, an air flow safety sensor 180 is provided in connection with the fan assembly 178. The air flow sensor 180 is electrically interconnected between the fan assembly 178 and the controller 24. In the event the operation of the fan assembly 178 is less than that necessary to maintain environmental exhaust requirements, operation of the apparatus 10 shuts off. By interconnecting satisfactory operation of the exhaust fan assembly 178 with operation of the apparatus 10, no build up of exhaust fumes is permitted within the apparatus. Manual operation of the fan assembly 178 is also provided via the key pad controls 25.

Once the cylindrical items are cured within the drying chamber 160 they are removed from their pin assembly work stations 62 on the transport system 16 by an inclined plate or ski member 182 similar to the ski member 64 used in the loading system 36. As illustrated in FIG. 1A, the ski member 182 is positioned at the exit 184 of the curing system 20'. The ski member 182 is mounted on the vertical support member 13A of the frame 12. The ski member 182 is mounted above the exit 184 on one side of the main chain 63 of the transport system 16. As the cylindrical items C are moved downwardly on pin assembly work stations 62, they engage the inclined ski member 182, and are disengaged from the pins 76 into engagement with the take-away system 22.

In the event a cylindrical item C is not properly removed from the assembly 76 by the ski member 182, a spring biased safety interlock 186 is provided to stop operation of the transport system 16. Like the safety interlock of the loading system 36, the safety interlock 186 is spring biased into position for normal operating conditions. In the event the pressure acting upon the ski member 186 exceeds normal operating conditions, the spring of the safety interlock is biased out of position and movement of the transport system 16 stops. The safety interlock stops movement of the entire apparatus 10 to prevent the possibility of any damage.

Upon exiting the drying chamber 160 via exit 184, the cured cylindrical items C are deposited to the take-away system 22. In the illustrated embodiment of FIG. 1A, the take-away system 22 includes an exit ramp 188, by which the items are gravity fed to a take-away container 190. The take-away container 190 may be used to transfer the items to a still further or final processing station. Alternatively, the items may be provided to a next or final process station via a conveyor system.

Accordingly, an apparatus for applying material to cylindrical items C has been described above which may be manually or automatically controlled. In the illustrated embodiment, the operating parameters, such as speeds and heights, of the part supply system 14, transport system 16, application systems 18, 18' and curing systems 20, 20', are programmed into the controller 24. The desired operating parameters for the systems are determined experimentally depending on the size of the cylindrical item C and the material M to be applied. Once the desired parameters are established, they are entered into the controller 24 for the various items and materials to be applied. Once the parameters are programmed into the controller 24, the systems of the apparatus 10 may be readily and automatically changed to apply the desired material to the desired items by entering the name of the desired cylindrical items and materials to be manufactured into the controller 24 using the key pad controls 25. Upon receiving instructions concerning the items and materials to be manufactured, the controller then adjusts the necessary operating settings of the various systems to produce the desired result. The controller 24 of the preferred embodiment is a conventional digital computer electrically interconnected with the power supplies and controls of the systems of the apparatus 10. As shown in FIGS. 1B and 1C, the controller interface includes a key pad control 25 for use by the operator of the apparatus 10.

The preferred form of the apparatus have been described above. However, with the present disclosure in mind it is believed that obvious alterations to the preferred embodiment, to achieve comparable features and advantages in other apparatus, will become apparent to those of ordinary skill in the art.

We claim:

1. An apparatus for application of a material to the external diameter of cylindrical items, said apparatus comprising a controller, a frame, a transport system, an application system, and a curing system for curing the material applied to cylindrical items, and said application system, said curing system, and a portion of said transport system, are enclosed to prevent migration of material fumes from said apparatus, said controller comprising a preprogrammed computer for automatically controlling the application of material to said items and movement of said items through said transport, application and curing systems depending on the material being applied, said frame for supporting said transport system, said transport system comprising a continuous conveyor having a plurality of work stations movably supporting and transporting cylindrical items to said application system and curing system, said application system comprising first and second horizontally, axially spaced application rolls, each of which is engagable with the external diameter of one or more cylindrical items when the items are supported at one of said work stations to apply the desired material, and a reservoir system having a material tank with material for engagement with said application rolls during engagement of said rolls with the cylindrical item, said reservoir system including an adjustment mechanism for selecting the desired thickness of application material to be applied to the external diameter of the cylindrical item, said cylindrical items being provided to said work stations via a loading system comprising a continuous conveyor, said conveyors of said transport and loading systems having a single drive mechanism which operates both of said conveyors, such that the cylindrical items are provided by said loading system conveyor to said transport system conveyor by movement of said drive mechanism and respective conveyor synchronized by said controller, and wherein said loading system conveyor comprises a plurality of blocks each having a concave cross-section capable of supporting cylindrical items and un inclined plate for continuously contacting and biasing items from supported engagement with said blocks into engagement with said transport system conveyor.

2. The apparatus of claim 1, wherein said work stations of said transport system conveyor comprise pin assemblies for supporting cylindrical items on an internal surface thereof.

3. The apparatus of claim 2, wherein a portion of said transport system conveyor within said curing system includes an inclined plate for removing cylindrical items from supported engagement on said pin assemblies.

4. The apparatus of claim 3, wherein said loading system conveyor further includes a safety switch positioned adjacent said inclined plate and said pin assemblies such that the failure of one cylindrical item to be properly supported on its respective pin assembly during operation of the apparatus activates said safety switch and thereby stops operation of the apparatus.

5. The apparatus of claim 4, wherein said portion of said transport system conveyor within said curing system further includes a safety switch positioned adjacent said inclined plate and said pin assemblies such that the failure of one cylindrical item to be properly removed from its respective pin assembly during operation of the apparatus activates said safety switch and thereby stops operation of the apparatus.

6. The apparatus of claim 1, wherein said portion of said transport system, application system and curing system are enclosed in part by removable covers, each removable cover having a safety switch positioned adjacent thereto, whereby removal of said cover during operation of the apparatus activates said safety switch and thereby stops operation of the apparatus.

* * * * *